United States Patent [19]

Stoltzman

[11] 4,210,974

[45] Jul. 8, 1980

[54] PORTABLE GOLF BALL WASHER

[76] Inventor: Gary L. Stoltzman, 1287 Kennard St., St. Paul, Minn. 55106

[21] Appl. No.: 57,286

[22] Filed: Jul. 13, 1979

[51] Int. Cl.[2] ..... A63B 47/04

[52] U.S. Cl. ..... 15/21 A

[58] Field of Search ..... 15/21 A, 97 R, 210 R, 15/160

[56] References Cited

U.S. PATENT DOCUMENTS

| | | | |
|---|---|---|---|
| 1,797,000 | 3/1931 | Laing | 15/21 A |
| 1,798,322 | 3/1931 | Floyd et al. | 15/21 A |
| 2,672,633 | 3/1954 | Allen | 15/21 A |

*Primary Examiner*—Edward L. Roberts
*Attorney, Agent, or Firm*—Jacobson & Johnson

[57] ABSTRACT

A hand-held ball washer having an enclosed chamber for holding the cleaning fluid and an adjacent ball cleaning chamber having brush bristles for cleaning the golf ball with means for applying the cleaning fluid onto the golf ball in the cleaning chamber and the cleaning chamber having an opening through which the ball can be held for cleaning and an opening through which the fluid and dirt drains out. A holder is also provided to move the golf ball up and down in the cleaning chamber while permitting it to rotate against the bristles for cleaning.

10 Claims, 4 Drawing Figures

PORTABLE GOLF BALL WASHER

BACKGROUND OF THE INVENTION

1. Field of the Invention

This invention is directed toward washers for golf balls and, particularly, toward a relatively small compact ball washer which can be held in one hand by the golfer and easily carried on his person or attached in some convenient fashion to the golf bag.

2. Description of the Prior Art

The following is a list of prior art U.S. patents on portable golf ball washers which applicant is presently aware of:

U.S. Pat. Nos. 3,119,533, 3,583,016, 3,271,802, 3,678,526, 3,380,095, D 233,361.

In the prior art, as illustrated by the above-identified patents, the chamber for holding the cleaning fluid and the ball cleaning chamber are one in the same. One difficulty with that type of arrangement is that since access must be had to the fluid holding chamber for inserting and removing the golf ball for cleaning it is very likely that fluid can leak out of the chamber such as when the ball washer is stored away in golf bag and the bag should be tossed about such as when moving or carrying it about with the ball washer inside. Another problem is that the cleaning fluid becomes contaminated from the dirt, etc. which is cleaned off the golf balls and the residue stays in the cleaning and fluid holding chamber. This requires the fluid to be periodically replaced and the chamber cleaned out.

SUMMARY OF THE INVENTION

A somewhat elongated generally cylindrical housing contains a completely enclosed chamber for holding the cleaning fluid and an adjacent partially open ball cleaning chamber with means, preferably a plunger operated spray, for applying the cleaning fluid from the fluid chamber to the ball cleaning chamber. The latter has an opening at its top for inserting the ball to be cleaned, an elongated opening through which the ball is held while being cleaned, and an opening at the bottom through which the fluid applied to the ball and any dirt will drain out. As a result, the fluid in the fluid holding chamber does not become contaminated with any of the dirt from the golf ball and the fluid and dirt do not accumulate in the ball cleaning chamber. The ball cleaning chamber is provided with bristles on its inner wall which the ball rubs against for cleaning. Preferably, the dimensions of the cleaning chamber are such that the ball fits fairly snugly against the cleaning bristles in the cleaning chamber. As a further feature, a ball holder is provided which is inserted into the cleaning chamber through the elongated opening and is used to move the ball up and down against the bristles in the cleaning chamber while permitting the ball to rotate so that it is more thoroughly cleaned.

As still another feature, the elongated opening and the opening at the bottom of the cleaning chamber are too small to allow the ball to pass completely through. In this fashion, then, when not in use for cleaning, a spare ball or two can be held in the cleaning chamber.

As yet another feature, the ball washer is arranged so that it can be held and operated with either the right or left hand.

DESCRIPTION OF THE PREFERRED EMBODIMENT

Figure 3:
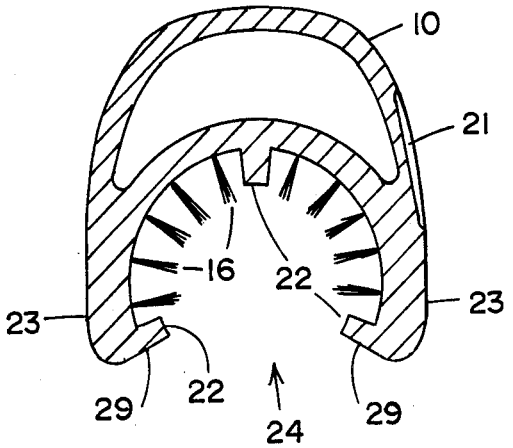
FIG. 3 is a view as seen along the viewing line 3—3 of FIG. 2.
Figure 4:
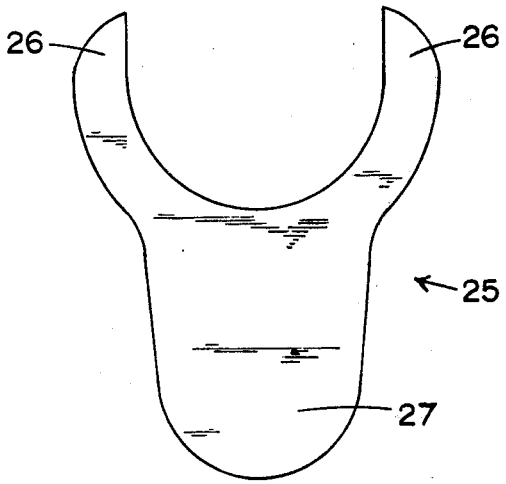
FIG. 4 illustrates a preferred embodiment of a holding device used for holding the ball while cleaning.
Figure 2:
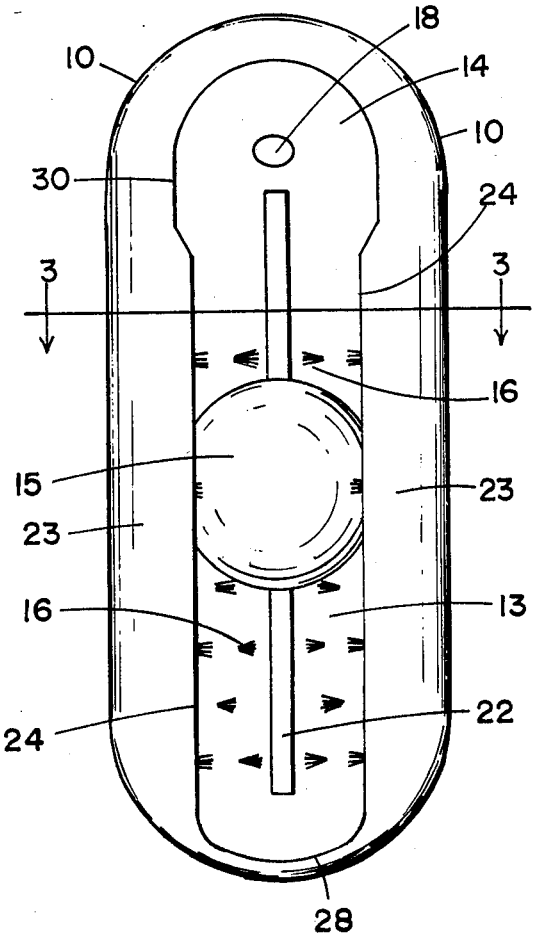
FIG. 2 is a view of the preferred embodiment as seen from what might be considered to be the front of the ball washer.
Figure 1:
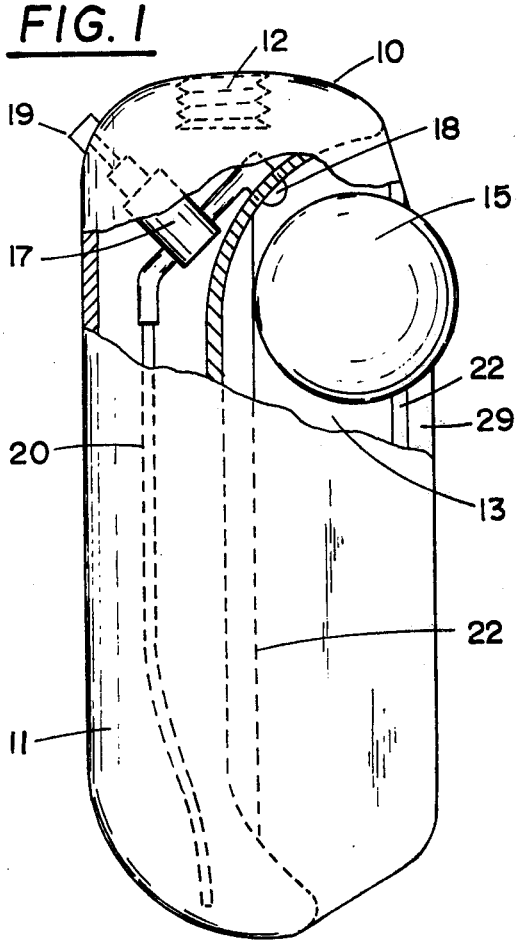
FIG. 1 is a partial tearaway of what might be considered a side view of the preferred embodiment of the invention.

A generally cylindrical elongated housing 10 is preferably made out of plastic but any suitable durable material is acceptable. The housing 10 contains a completely enclosed inner chamber 11 in which cleaning fluid is stored. A capped opening 12 into the fluid storing chamber 11 is provided through which the cleaning fluid is inserted into the chamber. A capped opening, not shown, may also be provided at the bottom of the chamber 11 for drainage, if desired.

Also within housing 10 and adjacent the fluid holding chamber 11, is an elongated partially open ball cleaning chamber 13. The latter has an opening 14 at the top through which a ball 15 is inserted for cleaning. Cleaning bristles 16 of any suitable type are attached along the inner wall of the cleaning chamber 13. The arrangement of the cleaning bristles is a matter of choice but it is preferred that enough bristles be provided and located over a substantial length of the cleaning chamber so that they will clean a ball in a fairly efficient fashion without undue wear. The manner of attaching the bristles is also a matter of choice and is not considered an essential part of the invention. The only requirement is that the bristles be attached in a fashion so they are not readily dislodged with use.

Preferably, a spray mechanism, identified generally with reference numeral 17, is located in the fluid holding chamber 11 for applying the cleaning fluid onto a ball located in the cleaning chamber 13. Th selection of a suitable spray mechanism is a matter of choice and the design for the spray mechanism is not considered a part of the instant invention. The nozzle 18 is directed toward the upper part of the cleaning chamber so that the fluid will strike the ball when it is first inserted in the cleaning chamber 13. Tube 20 extends to the bottom of the fluid holding chamber 11 to bring the fluid up to the nozzle in the well-known fashion. The end of the tube preferably has a filter, not shown, so that foreign material does not get into the nozzle to clog it. Preferably, the sprayer is operated by a plunger 19 which has its outer end accessible on the outside of the housing 10 and manually operable easily by the press of a finger. This permits the user to insert the golf ball in the cleaning chamber with one hand while holding the ball cleaner and depressing the plunger 19 with the other hand to spray cleaning fluid against the ball. Instead of a plunger operated spray device, the fluid holding chamber 11 can be made of a soft pliable material and be used as a squeeze bottle to force cleaning fluid out of the fluid holding chamber into the ball cleaning chamber. It is also contemplated that the fluid holding chamber can be removable and replaceable in the housing 10.

The outer surface of the housing 10 may have a recessed area 21 as a convenience in holding the ball washer. Also, the outer surface may be dimpled, not shown, both for appearance and to help prevent the ball washer from slipping out of the grasp of the user. Furthermore, in general, the interior of the ball washer has curved surfaces to eliminate areas where dirt could build up.

Referring back to the cleaning chamber, it has elongated inwardly facing ribs 22 for guiding the ball in the cleaning chamber. The ribs 22 are located and dimensioned so that the ball will be in contact with the cleaning bristles 16. The ribs are also designed so that the ball has some freedom of movement but yet is confined to a fairly narrow area. Preferably, the design is such that the ball will be held against the bristles 16 so when not being moved it will just stay in place in the cleaning chamber.

The cleaning chamber 13 is formed in part by a pair of partially curved walls 23. An elongated opening 24 is formed between the edges of walls 23. At the bottom of the elongated opening 24 is a drain opening 28 through which any fluid or dirt in the cleaning chamber 13 drains out. At the top is an opening 30 through which ball 15 is inserted. The opening 24 is dimensioned so that the ball cannot pass through it and preferably the drain opening 28 is large enough to allow all the dirt and fluid to drain out but not large enough to permit the ball to pass through. The outer surfaces 29 of the edges of the walls 23 which are along the sides of the elongated opening 24 are slanted inward toward the cleaning chamber 13 to serve as guides for the handle 27 of the holder 25 when ball holder 25 is being used to move the ball up and down in the cleaning chamber.

Although the ball can be held by hand for cleaning, it is preferred that a holder 25 be used. The holder has a pair of arcuate fingers 26 and a handle portion 27. The holder is dimensioned so that the fingers 26 fit loosely around the ball through the elongated opening 24 and is used to move the ball up and down in the cleaning chamber against the bristles. The loose fit of the fingers 26 allows the ball to rub against the brush bristles and rotate as it is moved up and down in the cleaning chamber to thoroughly clean the golf ball.

As an example, a hand held portable ball washer was constructed having an overall length in the order of 7-3/16 inches, a diameter (considering the device being generally cylindrical) of about 3⅛ inches, an elongated opening in the cleaning chamber about 1½ inches wide and having about seven rows of bristles spaced about ½ inch apart starting about three inches from the top of the ball washer. The holder 25 has an overall length of about 3-1/16 inches, an overall width of about 2½ inches with the arcuate fingers being, at their widest part, about ⅜ inch wide and the radius of curvature of the arcuate fingers about ⅞ inch.

Although not shown, the ball washer can be placed in a pocket in a golf bag when not being used or can be clipped or conveniently attached to the golf bag, golf cart, or to some article of clothing or the like for use.

I claim:

1. A portable golf ball washer, comprising:

a. a substantially cylindrical elongated housing;

b. a completely enclosed chamber within said housing for storing cleaning fluid;

c. an elongated ball cleaning chamber within said housing having:

1. an opening for receiving a ball to be cleaned,
2. an elongated opening to permit holding the ball while cleaning,
3. an opening at the bottom for draining out dirt and cleaning fluid, and
4. cleaning means on an inner wall;

d. and means for applying cleaning fluid from said enclosed chamber to a ball located in the ball cleaning chamber.

2. The portable ball washer as described in claim 1 wherein the elongated opening and the bottom opening of the cleaning chamber are not large enough to permit a ball to pass through.

3. The portable ball washer as described in claim 1 wherein said ball cleaning chamber is constructed so that a ball in the cleaning chamber contacts the cleaning means for cleaning.

4. The portable ball washer as described in claim 3 wherein said means for applying cleaning fluid comprises a spray device having a manually operable plunger accessible outside the housing and a nozzle directed toward the ball cleaning chamber.

5. The portable ball washer as described in claim 3 wherein at least part of said fluid holding chamber is made of a pliable material such that it can be manually squeezed to force fluid out and into the ball cleaning chamber.

6. The portable ball washer as described in claim 4 wherein said cleaning chamber has inwardly directed ribs on its inner wall directing the ball against the cleaning means.

7. The portable ball washer as described in claim 3 wherein part of the wall of the fluid storing chamber constitutes at least part of the wall of the ball cleaning chamber.

8. The portable ball washer as described in claim 7 further including holding means for holding the ball through the elongated opening for cleaning.

9. The portable ball washer as described in claim 8 wherein said ball holding means is constructed to permit the ball to rotate as it rubs against the cleaning means when being moved in the cleaning chamber by said ball holding means.

10. The portable ball washer as described in claim 8 wherein said ball holding means comprises a handle and a pair of arcuate fingers for placing loosely around the ball whereby the ball holding means can be used to move the ball in the cleaning chamber while permitting the ball to rotate as it rubs against the cleaning means.

* * * * *